United States Patent [19]

Collins

[11] Patent Number: 4,930,382

[45] Date of Patent: Jun. 5, 1990

[54] METHOD AND APPARATUS FOR CUTTING PLANAR PIECES INTO PATTERNED SHAPES

[76] Inventor: Ellen A. E. Collins, 5708 Heming Ave., Springfield, Va. 22151

[21] Appl. No.: 307,471

[22] Filed: Feb. 8, 1989

[51] Int. Cl.[5] ..... A41H 15/00

[52] U.S. Cl. ..... 83/13; 83/565; 33/17 R; 33/562; 33/DIG. 1

[58] Field of Search ..... 83/13, 451, 565, 465; 33/562, 563, 12, 17 R, DIG. 1; 269/8; 112/121.12

[56] References Cited

U.S. PATENT DOCUMENTS

| | | | |
|---|---|---|---|
| 1,592,750 | 7/1926 | Spektor . | |
| 1,742,684 | 1/1930 | Bowman . | |
| 2,355,023 | 8/1944 | Wiren | 112/121.12 |
| 2,411,328 | 12/1946 | Macnab | 33/12 |
| 3,745,656 | 7/1973 | Sweeney | 33/14 |
| 3,837,084 | 9/1974 | Johnson | 33/17 R |
| 3,949,629 | 4/1976 | Johnson | 83/27 |
| 4,053,986 | 10/1977 | Axelrod | 33/17 R |
| 4,435,906 | 3/1984 | Mori | 33/DIG. 1 X |
| 4,642,896 | 2/1987 | Grimm | 33/17 R |
| 4,780,960 | 11/1988 | Merz | 33/17 R |

*Primary Examiner*—Frank T. Yost
*Assistant Examiner*—Eugenia A. Jones
*Attorney, Agent, or Firm*—Hoffman, Wasson, Fallow & Gitler

[57] ABSTRACT

A convenient method and simple apparatus for cutting one or more layers of planar material, such as fabric into uniform, geometric shapes, involving the use of relatively small, thin geometrically shaped magnetic templates. The method and apparatus is particularly useful in preparing fabric pieces to be sewn together in order to produce a patchwork quilt.

6 Claims, 1 Drawing Sheet

METHOD AND APPARATUS FOR CUTTING PLANAR PIECES INTO PATTERNED SHAPES

BACKGROUND OF THE INVENTION AND DESCRIPTION OF THE PRIOR ART

One of the most important steps in the great American art of patchwork quilt-making involves the tasks of cutting many decorative and colorful fabric pieces into the shapes that will be useful in the final quilt product. In the past, the task of cutting the fabric pieces has been laborious and time-consuming, and did not always yield fabric pieces that are uniform enough in size and shape to be useful.

The most common method of preparing pieces for a quilt involves cutting a cardboard pattern and then tracing with a pencil on the fabric. The pattern is then cut out individually. Alternatively, the fabric is held in place manually and the excess fabric trimmed with scissors. The main disadvantage of both of these methods is the fabric tends to shift, sometimes causing the pieces to be cut inaccurately. Additionally, the former method is time-consuming because of the extra step of tracing. It is also less useful on dark fabrics.

This problem of adequately producing a finished piece of fabric or quilt of a particular pattern has been addressed by a number of U.S. Patents including U.S. Pat. No. 2,411,328 to MacNab; U.S. Pat. No. 3,745,656 to Sweeney; U.S. Pat. No. 3,949,629 to Johnson; U.S. Pat. No. 3,837,084 to Johnson; and U.S. Pat. No. 1,053,986 to Axelrod.

The patent to MacNab discloses a dressmaker's pattern formed of the usual thin, tissue-like paper, cellophane or other similar material. A relatively weak adhesive is applied to the pattern for temporarily securing it to the fabric during cutting.

The patent to Sweeney teaches a pattern-making template for producing highly customized garments which includes a number of template sections or pieces. The individual template sections are freely movable with respect to one another, so that the overall size and shape of the resulting template as a whole, and hence, the pattern produced by tracing around the margin of the adjusted template, may be varied in order to conform to the proportions of the customer.

The Johnson U.S. Pat. No.3,949,629 shows a method of cutting fabric pieces for garments, employing four magnetic objects, a horizontal planar cutting surface and a thin paper sheet pattern piece. The magnetically attractable object facilitate the positioning of the thin paper sheet pattern piece, with respect to the fabric, when placed atop the horizontal planar cutting surface prior to and during the cutting operation.

The Johnson U.S. Pat. No. 3,837,084 teaches a method and device for temporarily retaining and adjusting a paper pattern on a piece of cloth that is about to be cut. The device includes a small, flat magnetic plate and a heavy, small piece of metal. Once the magnetic plate is placed on the underside of the pattern, placing the heavy piece of metal is then placed over the face of a paper pattern. When properly arranged, both the paper pattern and the fabric to be cut are clamped between the metal object and the magnetic plate.

The patent to Axelrod discusses a method of producing fabric pieces for a patchwork quilt involving the use of relatively rigid, adhesive backed material, such as cardboard, which is adhered to the surface of the fabric to be cut for the patchwork quilt. The patchwork section is then cut out, with necessary seam skirts located therearound, using the edges of the cardboard as a cutting guide. Finally, the cardboard is removed from the fabric piece and the fabric piece is sewn into the quilt.

All of the foregoing patents fail to discuss the use of magnetic pattern pieces as disclosed by the instant invention. The instant invention is superior to the prior art in that the instant magnetic pattern pieces are small, lightweight, inexpensive and do not leave a residue on the fabric from adhesive backed pattern pieces. Furthermore, the magnetic pattern pieces serve as a cutting guide, while simultaneously holding the fabric in place during cutting.

SUMMARY OF THE INVENTION

The present invention overcomes the above mentioned drawbacks in the prior art by providing a simple, easy-to-use and inexpensive method and apparatus for cutting uniform, variously shaped pieces of fabric.

The apparatus of the present invention incorporates two small relatively thin ferrous or magnetic templates that are geometrically shaped, or shaped to the design of any particular pattern. When geometrically shaped, the templates could be circles, triangles, stars, etc. The magnetic templates serve as pattern pieces to which a piece of fabric can be cut to conform to the shape of the template. The resulting cut fabric will also conform to the size of the template. Additionally, it is noted that one or both of the templates can be constituted from magnetic material. When both templates are magnetic, they should exhibit opposite polarity.

The particular method of using the template is quick, and will yield fabric pieces that are uniform and consistent in size and shape. After the fabric is cut, the templates are removed and the resulting pattern shaped fabric pieces may be sewn together in any convenient manner. The present invention contemplates the use of a manual method of cutting the fabric, such as by the use of shears, but stamping or laser cutting would be useful for large scale production. Furthermore, the templates serve to hold the fabric in place while the fabric is being cut.

Although the present invention is ideally suited for creating fabric pieces for use in a patchwork quilt, the usefulness of the invention can easily be extended to the craft of cutting fabric pieces for use in any article that is to be sewn.

BRIEF DESCRIPTION OF THE DRAWINGS

The present invention can better be understood by referring to the following drawings, wherein like reference characters refer to like parts throughout the several views.

DETAILED DESCRIPTION OF THE PREFERRED EMBODIMENT

Figure 1:
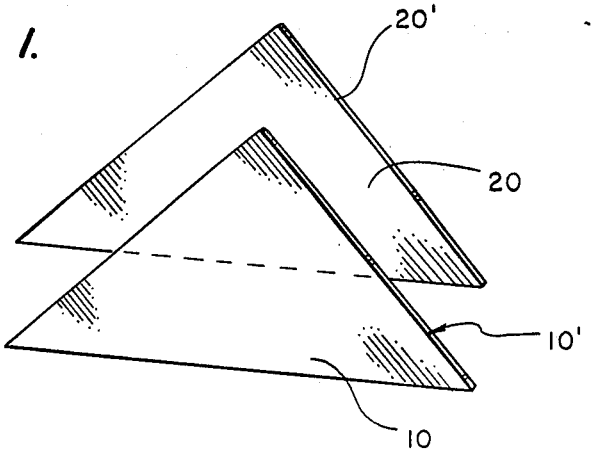
FIG. 1, shows an overall view of both templates displayed in a spaced-apart relation.

Referring to the figures, FIG. 1 shows two relatively thin templates 10, 20 displayed in a spaced-apart manner. These templates 10, 20 may typically be 1/64 inch thick, but there is no minimum or maximum limit to their thickness. Each template 10, 20 is provided with a planar surface 10', 20', respectively. Each of the templates can be constructed from a ferrous material. Alternatively and preferably, one or both of the templates are constituted from a magnetic material. When both templates are magnetic, their magnetic polarities are attractive.

The templates 10, 20, may be configured to display virtually any geometric shape or particular pattern. For example, as illustrated in FIG. 1, a triangular shape is illustrated.

Figure 2:
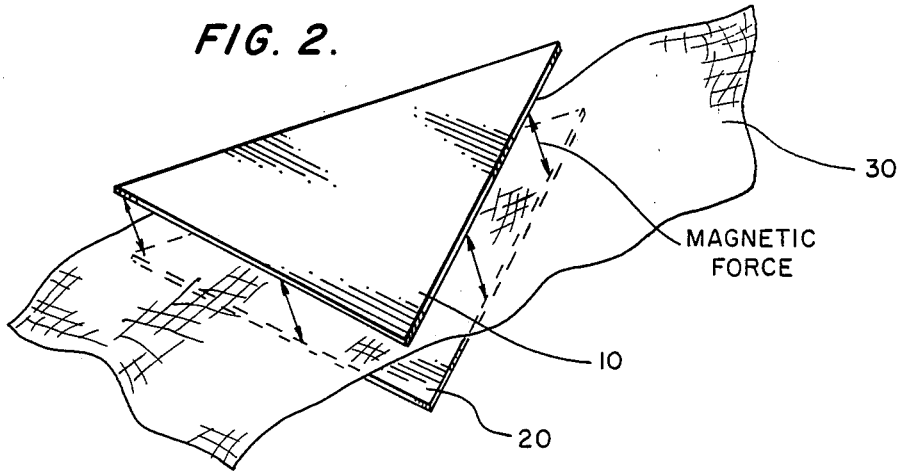
FIG. 2 shows an overall view of both templates surrounding a fabric piece in preparation for cutting; and, FIG. 3 shows a fabric piece being cut according to the shape of the magnetic template.
Figure 3:
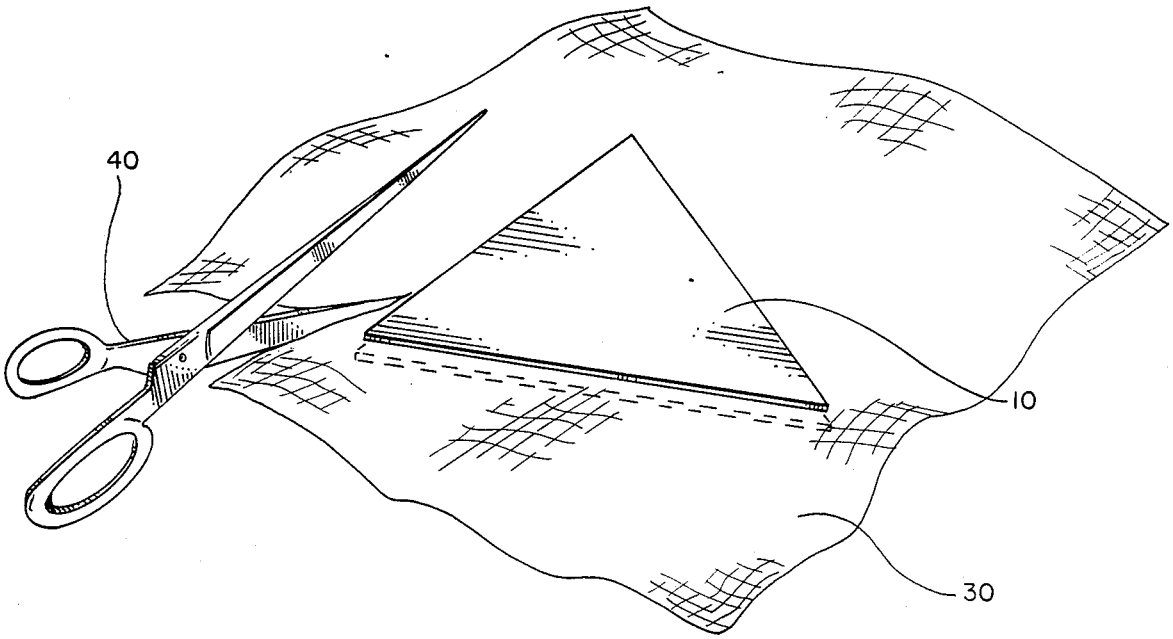

FIG. 2 shows the templates 10, 20 as it is being prepared for use to cut a piece of fabric 30. Template 10 is placed on one side of the fabric 30, while template 20 is placed on the other side in congruent registration with template 10 when both of the templates are magnetic. The opposing magnetic polarities of templates 10 and 20 causes them to attach to one another, through the fabric 30, so as to clamp the fabric 30 therebetween. When in the final attached and registered position, fabric 30 is ready to be cut, as shown in FIG. 3. Shears 40 or other cutting implements would then serve as a convenient means of cutting the fabric 30 by using the outline of articles 10, 20 as a guide.

Once a piece of fabric 30 has been completely cut-out according to the outline of templates 10, 20, the magnetic attractiveness of articles 10, 20 is interrupted by simply pulling them apart, and the freshly cut piece of fabric 30 is removed. Once removed, the resulting fabric piece (not shown) may readily be joined with other fabric pieces in order to form a quilt. Templates 10, 20 can then be re-used in cutting other fabric pieces in a like fashion.

While the principles of the present invention have been described with specificity, it is to be clearly understood that this description is made only by way of example and not as a limitation to the scope of the invention as set forth therein or in the accompanying claim. For example, the method of the present invention is not to be limited to the cutting of fabric or quilt pieces, but can be extended to cutting virtually any planar material such as vinyl, plastic or paper.

What is claimed is:

1. A method for cutting planar material pieces into particular patterns or shapes for use in the production of articles, comprising the steps of:

(a) placing a first template on one side of the planar material piece to be cut, said template shaped in a particular outline corresponding to the finished pattern or shape of the planar material;

(b) placing a second template, said second template being physically unattached to said first template, on the opposite side of the same piece of planar material, said second template shaped in the manner identical to that of said first template, whereby said second template is in congruent alignment with said first template; and (c) cutting the planar material along the outline of said first and second templates, whereby the resulting cut material piece is shaped according to the shape of said templates.

2. The method for cutting planar material pieces in accordance with claim 1, wherein one of said templates is constructed from magnetic material and one of said templates is constructed from ferrous material.

3. The method for cutting planar material pieces in accordance with claim 1, wherein both of said templates are constructed from magnetic material.

4. A device for accurately producing shaped planar material pieces comprising:

(a) a first template shaped in the form of a particular pattern;

(b) a second template, said second template being physically unattached to said first template, having the same shape as said first template;

whereby said first and second templates register in congruent alignment with one another and are adapted to hold a piece of planar material therebetween for cutting the fabric to conform to the outline of said first and second templates.

5. The device for cutting planar material pieces in accordance with claim 4, wherein one of said templates is constructed from magnetic material and one of said templates is constructed from ferrous material.

6. The device for cutting planar material pieces in accordance with claim 4, wherein both of said templates are constructed from magnetic material.

* * * * *